US006942134B2

(12) United States Patent
Naito

(10) Patent No.: US 6,942,134 B2
(45) Date of Patent: Sep. 13, 2005

(54) SELF-PIERCING RIVET SETTING MACHINE

(75) Inventor: Nobuharu Naito, Toyohashi (JP)

(73) Assignee: Newfrey LLC, Newark, DE (US)

( * ) Notice: Subject to any disclaimer, the term of this patent is extended or adjusted under 35 U.S.C. 154(b) by 88 days.

(21) Appl. No.: 10/680,987

(22) Filed: Oct. 8, 2003

(65) Prior Publication Data

US 2004/0111878 A1 Jun. 17, 2004

Related U.S. Application Data

(63) Continuation of application No. PCT/US02/10964, filed on Apr. 9, 2002.

(30) Foreign Application Priority Data

Apr. 17, 2001 (JP) ..... 2001-117912

(51) Int. Cl.[7] ..... B21J 15/30

(52) U.S. Cl. ..... 227/51; 227/107; 227/112; 227/119; 29/716; 72/391

(58) Field of Search ..... 227/51, 55, 107, 227/119, 135, 139, 2; 29/243.53, 432.1, 716; 72/424, 14, 391, 453.17

(56) References Cited

U.S. PATENT DOCUMENTS

| | | | | |
|---|---|---|---|---|
| 4,044,462 A | * | 8/1977 | Anselmo | 29/809 |
| 4,577,794 A | * | 3/1986 | Armstrong et al. | 227/119 |
| 4,662,206 A | * | 5/1987 | Mauer et al. | 29/812.5 |
| 5,104,024 A | * | 4/1992 | Brewer et al. | 227/2 |
| 5,964,393 A | | 10/1999 | Feldpausch et al. | |
| 6,385,843 B1 | * | 5/2002 | Singh et al. | 29/798 |
| 6,502,008 B2 | * | 12/2002 | Maurer et al. | 700/175 |

FOREIGN PATENT DOCUMENTS

| | | |
|---|---|---|
| DE | 201 00 628 U1 | 4/2001 |
| EP | 0 893 179 A2 | 1/1999 |
| WO | WO 94/14554 | 7/1994 |
| WO | WO 00/07751 | 2/2000 |

* cited by examiner

*Primary Examiner*—Scott A. Smith
(74) *Attorney, Agent, or Firm*—Harness, Dickey & Pierce, P.L.C.

(57) ABSTRACT

A self-piercing rivet setting machine 1 comprises a C-shaped frame 3, a punch 9 disposed at one end of the C-shaped frame 3, and a die 10 disposed at the other end of the C-shaped frame 3. The punch is attached to the edge of a receiver unit 14 and it is pressed against the die by a punch-driving unit 11. A plurality of workpieces are placed between the punch and the die to be connected with each other by driving a self-piercing rivet in the workpieces to cause the self-piercing rivet to pierce the workpieces. The receiver unit 14 includes a hollow shaft 17 having one end connected with a feeding tube 13 extending from a feeding device. The hollow shaft 17 is supported by a support tube 15 of the C-shaped frame 3. The receiver unit 14 further includes a receiver head 18 having an edge to which the punch is attached. The receiver head 18 is formed to receive the self-piercing rivet fed from the other end of the hollow shaft 17 and to allow the received self-piercing rivet to be held by the punch one by one. The hollow shaft 17 is supported to the support tube 15 slidably in the axial direction and rotatably in the circumferential direction thereof. The receiver head 18 is connected to the hollow shaft 17 to be selectively moved to either a first position (FIG. 1) where the punch is faced with the die or a second position (FIG. 2) where the punch is spaced apart from the die, according to the sliding and rotating of the hollow shaft.

6 Claims, 3 Drawing Sheets

SELF-PIERCING RIVET SETTING MACHINE

CROSS-REFERENCE TO RELATED APPLICATIONS

This application is a continuation of copending international patent application PCT/US02/10964 filed on Apr. 9, 2002 and designating the U.S., and claims priority of Japanese patent application 2001-117912, filed Apr. 17, 2001, which is incorporated herein by reference.

FIELD OF INVENTION

The present invention relates to a self-piercing rivet setting machine. More specifically, the present invention relates to a self-piercing rivet setting machine for connecting two or more sheet members (or a sheet member and a component) by using a self-piercing rivet in a sheet-metal assembling work such as automobile assembling (particularly, an aluminum body assembly operation).

BACKGROUND OF THE INVENTION

One example of a self-piercing rivet setting machine is described in Japanese Patent Laid-Open No. 8-505087. FIG. 1 therein shows one example of a self-piercing rivet. The self-piercing rivet comprises a flange-shaped head and a leg extending downward from the head. When the self-piercing rivet is driven into workpieces, such as two car body panels, by using a punch and a die, the leg is deformed to expand the edge of the leg while piercing (boring) the panels. In this manner, the both panels are connected with each other through the expandedly deformed leg and the head. The self-piercing rivet is suitable for assembling an aluminum body to which welding is not applicable. Since aluminum bodies are increasingly employed to facilitate weight reduction in automobile bodies, the demand for the self-piercing rivet would increase in the future.

While not shown in the aforementioned publication, Japanese Patent Laid-Open No. 11-90575 shows one example of a self-piercing rivet setting machine in FIG. 2 thereof. As shown in that figure, the self-piercing rivet setting machine comprises a C-shaped frame including an upper horizontal arm, a vertical arm, and a lower horizontal arm. The self-piercing rivet setting machine further includes a punch provided at one end of the C-shaped frame, a die provided at the other end of the C-shaped frame, and a punch driving means, such as a motor and a spindle, for pressing the punch against the die to press a self-piercing rivet supported by the punch against the die. A plurality of members are placed between the punch and the die to be connected with each other by driving the self-piercing rivet into the members while piercing the members by the self-piercing rivet. A conventional rivet setting machine typically includes a feeding device and receiver means for automatically feeding rivets to a punch. These components can be attached to a self-piercing rivet setting machine. Actually, there is a self-piercing rivet setting machine equipped with these components. In that machine, the punch is attached to the edge of a receiver unit for receiving the self-piercing rivet fed from the feeding device to hold the self-piercing rivet therein The punch is moved toward the die by the punch driving means provided on one end of the C-shaped frame. Then, a plurality of members are placed between the punch and the die to be connected with each other by driving the self-piercing rivet in the members while piercing the members by the self-piercing rivet. Such conventional self-piercing rivet setting machines can advantageously achieve and maintain high sealing performance to the interior of an automobile because the leg of the self-piercing rivet can connect the workpieces each other without penetrating therethrough.

As described above, the self-piercing rivet setting machine essentially comprises the C-shaped frame including the upper horizontal arm, the vertical arm and the lower horizontal arm. In order to resist high riveting load or force, the C-shaped frame is typically formed in an integral structure. Thus, upon no-operation of the setting machine, there is a certain but not so great distance between the punch disposed at one end of the C-shaped frame (the end of the upper horizontal arm) and the die disposed at the other end of the C-shaped frame (the end of the lower horizontal arm) depending upon the size of the C-shaped frame. When the workpieces are simple flat plates, they are relatively easy to locate them between the punch and the die. However, when the workpiece partially includes a standing wall extending therefrom at a right angle, there is sometime the case that the workpiece cannot be positioned between the punch and the die. In that case, it is require to replace the C-shaped frame with a lager C-shaped frame so as to increase the distance between the punch and the die. However, the overall size of the setting machine is increased due to the larger C-shaped frame having rigidity for resisting the high riveting load. Further, the driving means has a specific stroke for moving the punch of the setting machine. Thus, it is impractically necessary to replace with larger driving means designed for the larger C-shaped frame. As a result, a portion of the workpieces might not be connected, due to the shape of the workpieces. Further, the punch driving means includes a spindle fixedly connected with the receiver unit to which the punch was attached. This also constrains a settable region of workpieces to be connected.

It is therefore an object of the present invention to provide a self-piercing rivet setting machine capable of handling even a particular workpiece which has a standing wall requiring an widened distance between a punch and a die, without any need for providing a larger C-shaped frame.

SUMMARY OF THE INVENTION

In order to achieve the above object, according to the present invention, there is provided a self-piercing rivet setting machine comprising a C-shaped frame, a punch disposed at one end of the C-shaped frame, and a die disposed at the other end of the C-shaped frame. The punch is attached to the edge of a receiver unit for receiving a self-piercing rivet fed from a feeding device, so as to hold the self-piercing rivet. The punch is adapted to be pressed against the die by punch-driving means. A plurality of workpieces are placed between the die and the punch with the self-piercing rivet held thereby to be connected with each other by driving the self-piercing rivet in the workpieces to cause the self-piercing rivet to pierce the workpieces. Further, the receiver unit includes a hollow shaft having one end connected with a feeding tube extending from the feeding device. The hollow shaft is supported by support means provided on one end of the C-shaped frame. The receiver unit further includes a receiver head having an edge to which the punch is attached. The receiver head is adapted to receive the self-piercing rivet fed from the other end of the hollow shaft and allow the received self-piercing rivet to be held by the punch one by one. Furthermore, the hollow shaft is supported to the support means of the C-shaped frame slidably in the axial direction and rotatably in the circumferential direction of the hollow shaft, and the receiver head is connected to the hollow shaft so as to be selectively moved to either a first position where the punch is faced with the die or a second position where the punch is spaced apart from the die in both the axial and circumferential directions to provide enlarged distance between the die and the punch, according to the sliding and rotating of the hollow shaft.

According to the above machine, during the riveting operation, the operation is carried out at the first position where the punch is faced with the die. In case that workpieces have a standing wall requiring an extended distance between the punch and the die, during non-riveting operation, the receiver head is moved to the second position to provide the enlarged distance between the die and the punch, and therefore, the workpieces can be placed between the die and the punch. Then, the receiver head is moved to the first position to carry out the riveting operation. Thus, even if workpieces have a standing wall, the workpieces can be positioned between the die and the punch to carry out the riveting operation without using any larger C-shaped frame.

In the above self-piercing rivet setting machine, the support means may be a support tube formed as a part of the C-shaped frame. The support tube supports the outer peripheral surface of the hollow shaft of the receiver unit to allow the hollow shaft to be slid in the axial direction and rotated in the circumferential direction thereof. The punch driving means may include a spindle having an axis in parallel with the axis of the support tube of the C-shaped frame. The other end of the hollow shaft and a receiving port of the receiver head may be coupled with each other through a rigid and hollow coupling tube. The hollow shaft may have a continuous biasing force acting thereon in a direction allowing the punch coupled with the receiver head to be moved away from the die. The biasing force also allows the punch to be pressed onto the edge of the punch driving means. Further, the punch driving means may be formed with a tapered guide protruding from the edge thereof, and the receiver head holding the punch may be formed with a tapered guide hole having a shape in conformity with that of the tapered guide. This allows the axis of the punch to be readily aligned with the axis of the spindle.

DETAILED DESCRIPTION OF THE PREFERRED EMBODIMENT

Figure 1:
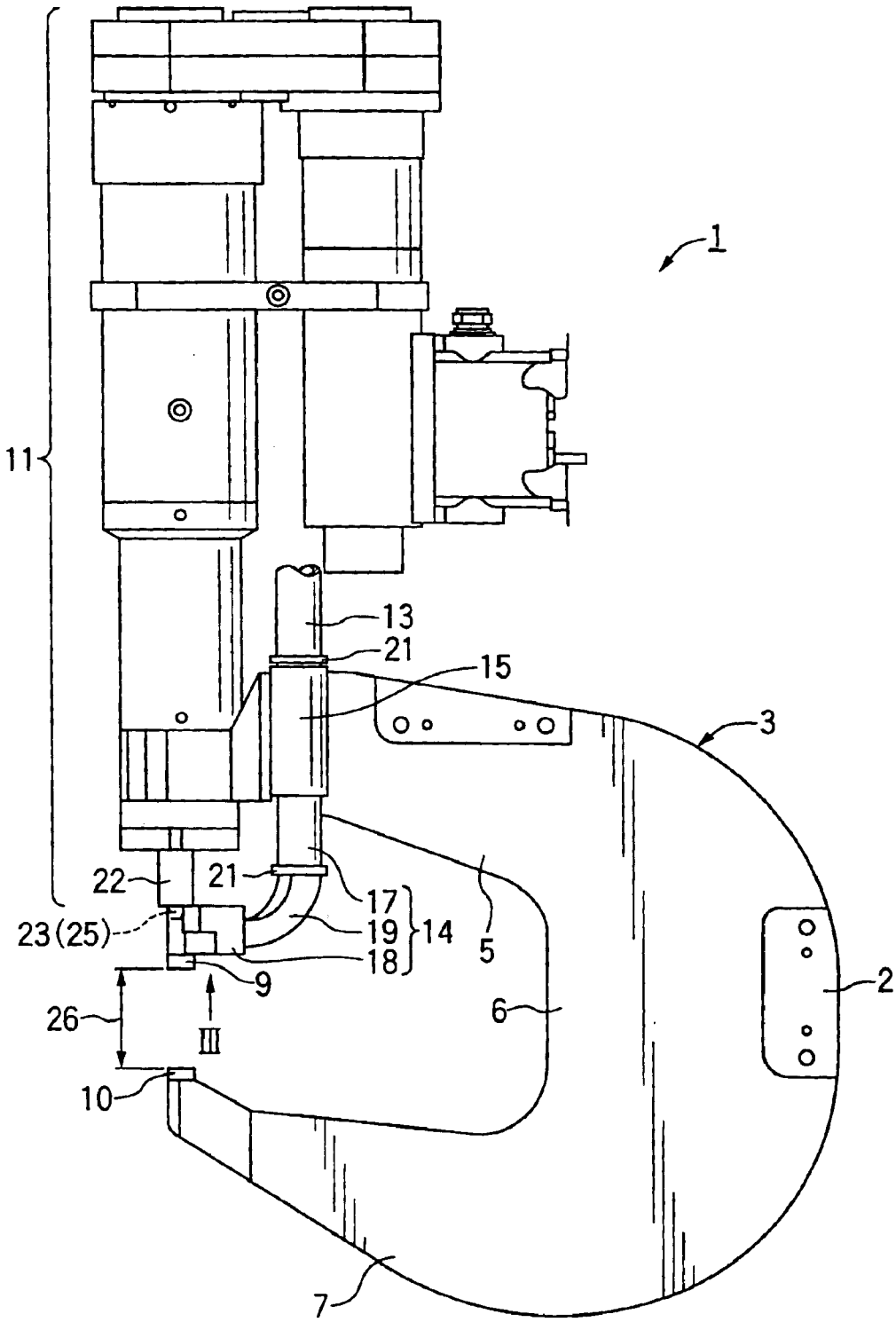
FIG. 1 is a block diagram of an entire self-piercing rivet setting machine according to the present invention, which shows the state when a receiver head of a receiver unit is located at a first position.
Figure 2:
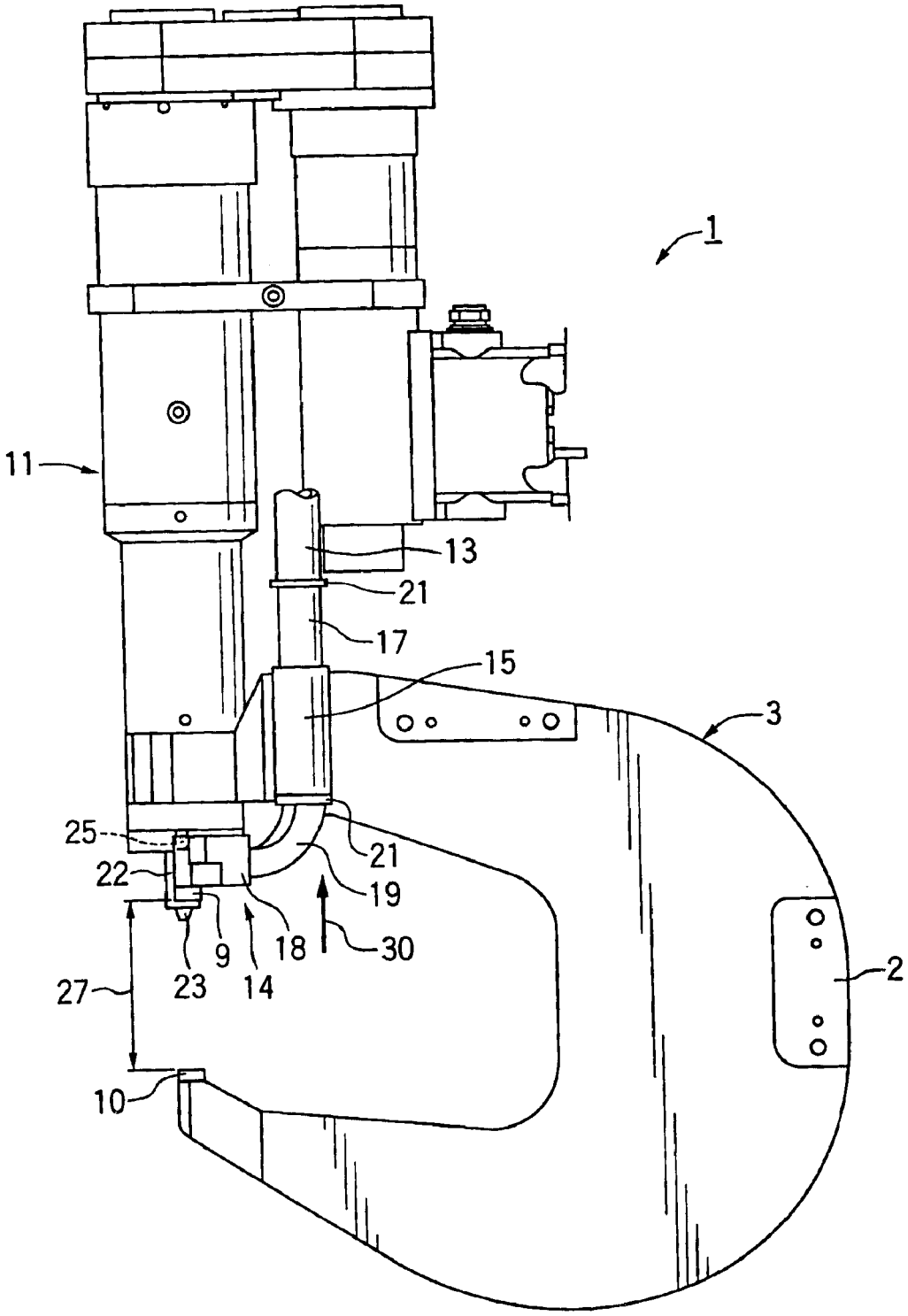
FIG. 2 is a block diagram of the entire self-piercing rivet setting machine, which shows the state when the receiver head of the receiver unit self-piercing rivet setting machine of FIG. 1 is located at a second position.
Figure 3:
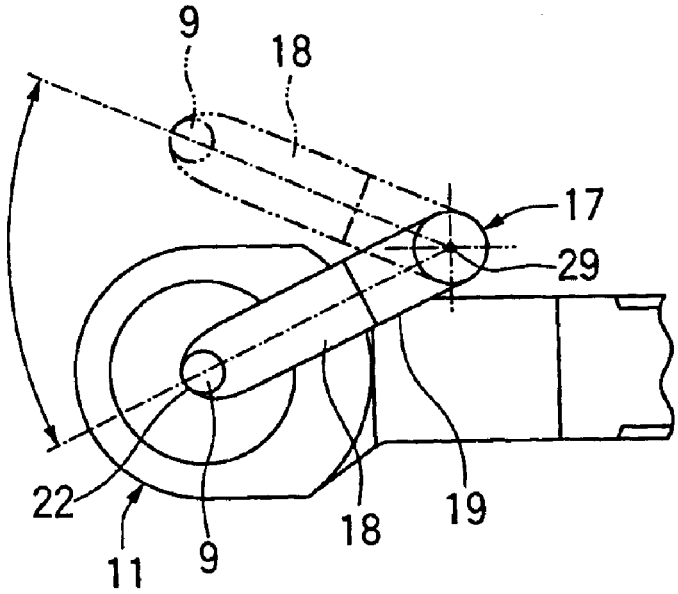
FIG. 3 is a view showing the relationship between the receiver unit and the punch-driving unit, wherein the self-piercing rivet setting machine of FIG. 1 is viewed from the direction of the arrow III.
Figure 4:
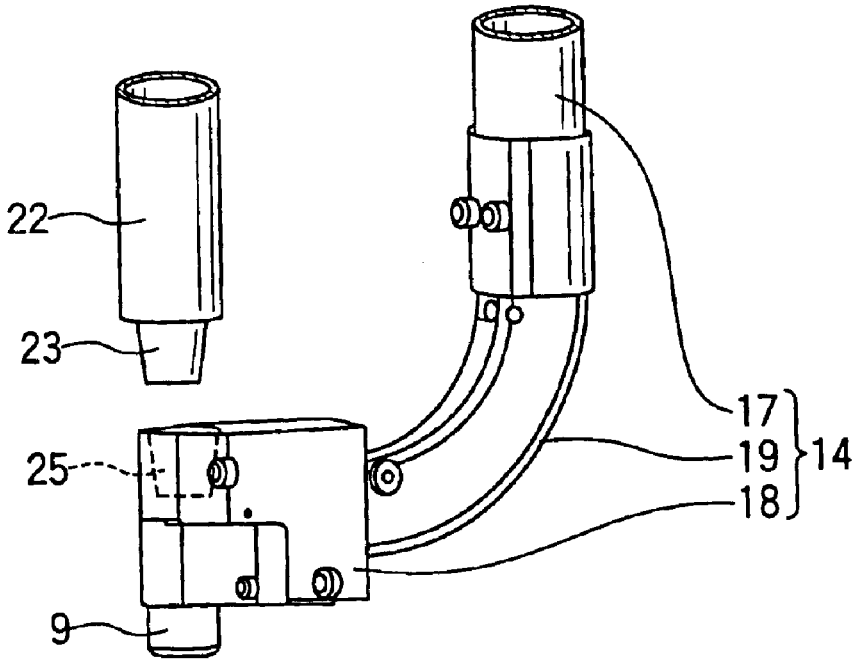
FIG. 4 is a partially enlarged view of a part of the receiver unit and the punch-driving unit, which shows the state when the receiver head of the receiver unit of the self-piercing rivet setting machine of FIG. 1 is being moved from the first position to the second position or vice versa.

An embodiment of the present invention will now be described. FIGS. 1 and 2 generally show a self-piercing rivet setting machine 1 according an embodiment of the present invention. In FIG. 1, a punch is located at a normal operation position where the punch is faced with a die. In FIG. 2, the punch is located at a position where the punch is spaced apart from the die. FIGS. 3 and 4 show the state that the punch held by a receiver unit is moved from the position where the punch is faced with the die. In FIG. 1, the self-piercing rivet setting machine 1 includes a C-shaped frame 3 having a coupling portion 2 to be coupled with an articulated robot arm (not shown). The C-shaped frame 3 is a rigid body integrally formed of an upper horizontal arm 5, a vertical arm 6 having the coupling portion 2, and a lower horizontal arm 7. One end of the C-shaped frame 3 or the end of the upper horizontal arm 5 is fixed to a cylindrical punch-driving unit 11 as punch driving means for driving a punch 9 toward a die 10 located below the punch during a riveting operation. The punch is adapted to hold a self-piercing rivet (not shown but make reference to the self-piercing rivet shown in FIGS. 1 and 2 in Japanese Patent Laid-Open No. 8-505087). In this embodiment, the punch-driving unit 11 comprises an electric motor, a spindle which is rotated and moved vertically by the motor, and a rod extending from the spindle to the punch. According to the rotation of the electric motor shaft, the spindle is moved downward to push the self-piercing rivet held by the punch 9, strongly toward the die 10. The punch 9 can be returned backward by the reverse rotation of the electric motor shaft. The die 10 is disposed at the other end of the C-shaped frame 3 or the end of the lower horizontal arm 7 to receive legs of the self-piercing rivet held by the punch 9.

The punch 9 is attached to the edge of a receiver unit 14 for receiving the self-piercing rivet fed from a feeding device (not shown) through a flexible feeding tube 13, so as to hold the self-piercing rivet. The receiver unit 14 is adapted to allow the self-piercing rivet automatically fed from the feeding device to be held by the punch 9 one by one with an adequate posture and timing. Differently from the conventional receiver unit, the receiver unit 14 of the present invention is adapted to be selectively moved to either a first position where the punch 9 held by the receiver unit is faced with the die 10 or a second position where the punch is spaced apart from the die to provide a certain enlarged distance between the die and the punch. In the self-piercing rivet setting machine 1 according to the present invention, a plurality of workpieces, for example, two workpieces are placed on the die 10 and then the punch with the self-piercing rivet held thereby is pressed downward onto the workpieces by operating the punch-driving unit 11, the leg of the self-piercing rivet is driven in the workpieces to cause the rivet to pierce both of them resulting in connection of the workpieces each other.

In the present invention, the receiver unit 14 includes a rigid hollow shaft 17 having one end coupled with the feeding tube 13 extending from the feeding device. The hollow shaft 17 is supported by a support tube 15 as support means provided at one end of the upper horizontal arm 5 of the C-shaped frame 3. The receiver unit 14 further includes a receiver head 18 having an edge to which the punch 9 is attached. The receiver head 18 is adapted to receive the self-piercing rivet fed from the other end (the lower end) of the hollow shaft 17 and allow the received self-piercing rivet to be held by the punch 9 one by one. Furthermore, the receiver unit 14 includes a hollow coupling tube 19 coupled between an outlet of the hollow shaft 17 and an inlet of a receiver head 18. Thus, the self-piercing rivet fed from the feeding tube 13 to the hollow shaft 17 is further fed to the receiver head 18 through the hollow coupling tube 19. The coupling tube 19 is formed in a hollow tubular body having rigidity. All of the hollow coupling tube 19, the hollow shaft 17 and the receiver head 18 are formed in rigid bodies and coupled integrally to define the receiver unit 14 having a fixed shape such as a J-shape as shown in the figures. In this receiver unit 14, the self-piercing rivet fed from the feeding tube 13 is fed to the receiver head 18 through each hollow portion in the hollow shaft 17 and the coupling tube 19. Then, the receiver head 18 allows the self-piercing rivet to be held by the punch 9 timely.

The hollow shaft 17 is formed in a hollow cylindrical shape, and the support tube 15 is formed at the end of the upper horizontal arm 5 of the C-shaped frame 3. The support tube 15 has a hollow cylindrical shape to surround and support the outer peripheral surface of the hollow shaft 17. The inner diameter of the support tube 15 is slightly larger than the outer diameter of the hollow shaft 18. Thus, the hollow shaft 17 is supported by the support tube 15 slidably in the axial direction of the hollow shaft 17 and rotatably in the circumferential direction (or about the axis) of the hollow shaft 17. The support tube 15 is formed in the C-shaped frame 3 to arrange its axis in parallel with the axis of the spindle of the punch-driving unit 11. This allows the hollow shaft 17 to be moved vertically in parallel with the spindle of the punch-driving unit 11. Consequently, the coupling tube 19 integrally coupled with the hollow shaft 17, the receiver head 18 and the punch 9 attached to the edge of the receiver head 18 can also be moved vertically in parallel with the axial direction of the spindle. Each of the upper and lower ends of the hollow shaft 17 is provided with a larger-diameter portion or a detachable larger-diameter ring 21 to prevent the hollow shaft 17 from coming off from the support tube 15.

The hollow shaft 17 has a continuous biasing force acting thereon in a direction to (the upward direction in FIG. 1) allowing the punch 9 coupled with the receiver head 18 to be moved away from the die 10. For example, this biasing force can be obtained by providing a compression coil spring (not shown) between the upper end of the support tube 15 and the upper-end ring 21 of the hollow shaft 17. Alternatively, the biasing force may be obtained by any other suitable biasing means for urging the hollow shaft 17 upward, such as a spring or an elastic member or means, or a combination of a magnet and an electromagnetic solenoid or a combination of a motor and a gear mechanism such as rack and pinion. By such biasing means, the hollow shaft 17 is pulled up in the axial direction of the support tube 15 or the axial direction of the spindle of the punch-driving unit 11, and thereby the receiver head 18 coupled with the hollow shaft 17 through the coupling tube 19 is pulled up in the axial direction of the spindle. Further, the punch 9 attached to the receiver head 18 is also pulled up in the axial direction of the spindle. Thus, the punch 9 is normally pressed elastically onto a guide 22 provided at the edge of the punch-driving unit 11 through the receiver head 18. The guide 22 is formed in a hollow body to guide a rod extending from the spindle. Thus, when the spindle of the punch-driving unit 11 is moved downward, the rod extends downward to push the receiver head 18 and the punch 9 downward against the biasing force urging the hollow shaft 17 upward. This allows the punch 9 to be pressed toward the die 10 reliably with an adequate posture.

The edge of the guide 22 at the edge of the punch-driving unit 11 is provided with a tapered guide bush 23 protruding downward as shown in FIGS. 2 to 4. Corresponding to the guide bush 23, the receiver head 18 holding the punch 9 is formed with a tapered guide hole 25 having a shape in conformity with that of the tapered guide bush 23. The axis of the guide bush 23 is arranged to align with the axis of the spindle, and the axis of the guide hole 25 is arranged to align with the axis of the punch 9. Thus, even if the guide hole 25 of the receiver head 18 is roughly positioning to the guide bush 23 of the punch-driving unit 11, the receiver head 18 is moved upward by the biasing force urging the hollow shaft 17 upward, and the guide hole 25 can be fitted with the guide bush 23. Then, this fit makes the axis of the spindle align with the axis of the punch 9. Thus, the pressing force of the punch-driving unit 11 is transmitted in a suitable direction with respect to the punch 9 to achieve desirable riveting operation. In this manner, the tapered guide bush 23 and the tapered guide hole allow the axes of the punch 9 and the spindle to be readily aligned with each other.

As shown in FIG. 1, in the riveting operation, the die 10 is fixed in the position (the first position) where the die 10 is faced with the punch 9. Thus, a normal opening distance 26 between the punch 9 and the die 10 is narrow. As described above, the receiver unit 14 of the present invention includes the hollow shaft 17 having one end (the upper end) coupled with the feeding tube 13 extending from the feeding device, and the hollow shaft 17 is supported by the support tube 15 provided at one end of the C-shaped frame 3 (the end of the upper horizontal arm 5). Further, the receiver unit 14 includes the receiver head 18 having an edge to which the punch 9 is attached, and the receiver head 18 is adapted to receive the self-piercing rivet fed from the other end (the lower end) of the hollow shaft 17 and allow the received self-piercing rivet to be held by the punch 9 one by one. Furthermore, the hollow shaft 17 is supported by the support tube 15 slidably in the axial direction and rotatably in the circumferential direction of the hollow shaft 17. Thus, according to the sliding and rotating of said hollow shaft 17, the receiver head 18 coupled with the hollow shaft 17 can be selectively moved to any one of the aforementioned first position shown in FIG. 1 where the punch 9 is faced with the die 10 and the second position shown in FIG. 2 where the punch 9 is spaced apart from the die 10 in both the axial and circumferential directions to provide enlarged distance (enlarged opening distance) 27 between the die and the punch.

The operation for changing from the first position of FIG. 1 to the second position of FIG. 2 is carried out during a non-riveting operation, such as an operation of placing workpieces or the like. In order to change from the first position to the second position, the receiver unit 14 composed of the receiver head 18, the coupling tube 19, and the hollow shaft 17 is pushed downward against the force urging the hollow shaft 17 upward. As a result of this operation, the hollow shaft 17 is moved downward along the support tube 15. Simultaneously, as shown in FIG. 4, the receiver head 18 is moved downward with the coupling tube 19. Thus, the guide hole 25 of the receiver head 18 is separated from the guide bush 23 at the edge of the guide 22 of the punch-driving unit 11, and thereby the receiver head 18 and the punch 9 are separated from the guide 22. In this separated state, the receiver head 18 and the punch 9 are rotated about the axis 29 (or in the circumferential direction) of the hollow shaft 17 from the position indicated by the solid line to the position indicated by the chain line, as shown in FIG. 3. By this rotating operation, the punch 9 and the receiver head 18 are moved to a position far from the punch-driving unit 11 in the radial direction of the punch-driving unit 11. In this position, when the force pushing the receiver head 18 downward is released, the receiver head 18 is moved upward together with the punch 9 by the force urging the hollow shaft 17 upward as shown by the arrow 30 in FIG. 2. Thus, the punch 9 is spaced apart from the die 10 in both the axial and circumferential directions of the hollow shaft, and is located at the second position having the enlarged opening distance 27 between the die 9 and the punch 10.

In this second position, a wider space can be assured between the punch 9 and the die 10. Thus, even if workpieces have a standing wall, the workpieces can be positioned between the punch 9 and the die 10 to carry out the riveting operation without using any larger C-shaped frame. Whereas the distance between the die and the punch has been about 150 mm in the conventional setting machine, an actual test proved that the setting machine according to the present invention could provide a reliable distance of 200 mm or more. When workpieces have a standing wall, the receiver head 18 holding the punch 9 is swung to the second position of FIG. 2 to provide an enlarged opening distance as the distance 27. This allows the standing wall which had a difficulty or impossibility of inserting through the prior art or conventional opening distance 26 (FIG. 1) to be placed in the C-shaped frame. Then, the receiver head 18 is pushed downward again to the position of FIG. 4. The receiver head 18 is then swung from the phantom line position in FIG. 3 to the solid line position therein, and the push-downward force is released at the solid line position. By this operation, the force urging the hollow shaft 17 upward acts to move the receiver head 18 and the punch 9 upward from the position in FIG. 4. Then, the guide hole 25 receives and fits with the guide bush 23, and the axis of the spindle is aligned with the axis of the punch 9 by the tapered guide hole 25 and the tapered guide bush 23. In this state, the receiver head 18 is coupled with the guide 22 of the punch driving means, and the punch is now returned to the first position of FIG. 1. The punch 9 returned to the first position 1 is aligned with the die 10 adequately, and thereby the riveting operation can be carried out adequately. In this manner, according to the present invention, the riveting operation can be carried out with keeping the standing wall of the workpieces alongside without any need for enlarging the C-shaped frame.

While the operations of moving the receiver head and the punch from the first position to the second position or from the second position to the first one may be manual operations, automatic operation means utilizing a power source such as an electric motor or pneumatic piston-cylinder may be used.

As described above, according to the present invention, while the die is located to face with the punch during the riveting operation, the die can be space apart from the punch to provide the enlarged distance between the die and the punch during the non-riveting operation. Thus, even if workpieces have a standing wall, the workpieces can be positioned between the die and the punch without using any larger C-shaped frame to carry out the riveting operation with keeping the standing wall alongside. This eliminates undesirable restrictions in regions to be connected. Further, in the receiver unit, the hollow shaft coupled with the feeding tube is integrally connected with the receiver head holding the punch to allow them to be separated from the punch-driving unit altogether. Thus, the self-piercing rivet can be fed to the receiver unit and held by the punch 9 when the receiver head is located not only at the first position but also at the second position.

We claim:

1. A self-piercing rivet setting machine comprising a C-shaped frame, a punch disposed at one end of said C-shaped frame, and a die disposed at the other end of said C-shaped frame, wherein said punch is attached to the edge of a receiver unit for receiving a self-piercing rivet fed from a feeding device to hold the self-piercing rivet, and said punch is adapted to be pressed against said die by punch-driving means, whereby a plurality of workpieces are placed between said die and said punch with the self-piercing rivet held therein to be connected with each other by driving said self-piercing rivet in said workpieces to cause said self-piercing rivet to pierce said workpieces; wherein said receiver unit includes;

a hollow shaft having one end connected with a feeding tube extending from said feeding device, said hollow shaft being supported by support means provided on said one end of said C-shaped frame, and a receiver head having an edge to which said punch is attached, said receiver head being adapted to receive the self-piercing rivet fed from the other end of said hollow shaft and allow said received self-piercing rivet to be held by said punch one by one, and;

wherein said hollow shaft is supported to said support means of said C-shaped frame slidably in the axial direction of and rotatably in the circumferential direction of said hollow shaft, and said receiver head is connected to said hollow shaft to be selectively positioned to either a first position where said punch is faced with said die or a second position where said punch is spaced apart from said die in both said axial and circumferential directions to provide an enlarged distance between said die and said punch, according to the slide and rotation of said hollow shaft.

2. A self-piercing rivet setting machine as defined in claim 1, wherein said support means is a support tube formed as a part of said C-shaped frame, said support tube supporting the outer peripheral surface of said hollow shaft of said receiver unit to allow said hollow shaft to be slid in the axial direction and rotated in the circumferential direction thereof.

3. A self-piercing rivet setting machine as defined in claim 2, wherein said punch driving means includes a spindle having an axis in parallel with the axis of said support tube of said C-shaped frame.

4. A self-piercing rivet setting machine as defined in claim 3, wherein said other end of said hollow shaft and a receiving port of said receiver head are coupled with each other through a rigid and hollow coupling tube.

5. A setting machine as defined in claim 4, wherein said hollow shaft has a continuous biasing force acting thereon in a direction allowing said punch coupled with said receiver head to be moved away from said die, said biasing force allowing said punch to be pressed onto the edge of said punch driving means.

6. A self-piercing rivet setting machine as defined in claim 5, wherein said punch driving means is formed with a tapered guide protruding from the edge thereof, and said receiver head holding said punch is formed with a tapered guide hole having a shape in conformity with that of said tapered guide.

* * * * *